US006290452B1

(12) United States Patent
Wächter

(10) Patent No.: US 6,290,452 B1
(45) Date of Patent: Sep. 18, 2001

(54) APPARATUS FOR REPLENISHING THE SUPPLY OF COMMODITIES IN A RESERVOIR

(75) Inventor: Michael Kleine Wächter, Lankau (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/376,181

(22) Filed: Aug. 17, 1999

(30) Foreign Application Priority Data

Sep. 19, 1998 (DE) ..... 198 42 965

(51) Int. Cl.[7] ..... B65B 35/50

(52) U.S. Cl. ..... 414/788.1; 414/789.9; 414/626; 414/796.2

(58) Field of Search ..... 414/789.9, 795.4, 414/796.9, 795.9, 796.2, 788.1, 788.4, 626; 294/67.33, 81.54, 907

(56) References Cited

U.S. PATENT DOCUMENTS

| | | | | |
|---|---|---|---|---|
| 3,953,021 | | 4/1976 | Seragnoli . | |
| 4,256,429 | * | 3/1981 | Dwyer | 414/626 |
| 4,278,378 | * | 7/1981 | Milholen | 414/32 |
| 5,074,745 | | 12/1991 | Neri . | |
| 5,340,263 | * | 8/1994 | Neri et al. | 414/412 |
| 5,564,893 | * | 10/1996 | Tacchi et al. | 414/796.9 |
| 5,630,559 | * | 5/1997 | Bucken et al. | 242/35.6 E |
| 5,664,931 | | 9/1997 | Brugger et al. . | |
| 5,997,240 | * | 12/1999 | Focke et al. | 414/797 |

FOREIGN PATENT DOCUMENTS

| | | |
|---|---|---|
| 385 015 | 2/1988 | (AT) . |
| 24 23 885 | 2/1975 | (DE) . |
| 26 39 676 | 3/1978 | (DE) . |
| 40 24 451 | 2/1991 | (DE) . |
| 40 24 451 A1 | 2/1991 | (DE) . |
| 94 00 777.2 | 11/1994 | (DE) . |
| 94 20 042.4 | 3/1995 | (DE) . |
| 0 528 772 A1 | 2/1993 | (EP) . |
| 03238237 | 10/1991 | (JP) . |
| 97/08085 | 3/1997 | (WO) . |

* cited by examiner

*Primary Examiner*—Joseph A. Fischetti
(74) *Attorney, Agent, or Firm*—Venable; Robert Kinberg

(57) ABSTRACT

A conveyor delivers successive stacks of blanks to a position at a level above a single magazine or to positions at levels above discrete plural magazines for stacked blanks. In order to avoid misalignment of blanks during replenishment of supplies of such blanks in the magazine or magazines, the level of the uppermost blank in each magazine is monitored and the thus obtained signals are utilized to release stacks of blanks for gravitational descent onto the remnant(s) of blanks in the magazine or magazines when the lowermost blank of a stack is located at a preselected distance from the uppermost blank(s) of the remnant(s) of the supply or supplies of blanks in the magazine(s). This can be accomplished by causing a stack of blanks above a magazine to descend relative to the dwindling supply of blanks in the magazine until the lowermost blank of the descending stack reaches a position at the selected distance from the topmost blank in the magazine.

17 Claims, 7 Drawing Sheets

APPARATUS FOR REPLENISHING THE SUPPLY OF COMMODITIES IN A RESERVOIR

CROSS-REFERENCE TO RELATED CASES

This application claims the priority of German patent application Ser. No. 198 42 965.7 filed Sep. 19, 1998. The disclosure of the German patent application, as well as that of each U.S. and foreign patent and patent application mentioned in the specification of the present application, is incorporated herein by reference.

BACKGROUND OF THE INVENTION

The invention relates to improvements in apparatus for replenishing the supplies of commodities in reservoirs or magazines, and more particularly to improvements in methods of and apparatus for introducing stacks of overlapping (preferably sheet- or panel-like) commodities into magazines which dispense the confined commodities (normally individually, i.e., seriatim) into one or more consuming or processing machines. One of the presently preferred applications of my method and apparatus is to dispense discrete blanks of paper, cardboard and/or plastic sheet or panel material for admission into packing machines for plain or filter cigarettes or other rod-shaped smokers' products It is customary to feed successive blanks from the bottom of a stack of blanks to a cigarette packing machine, e.g., a machine for the making of containers or boxes known as hinged-lid packets. A stack of superimposed blanks is stored in a magazine wherein the bottom zone has a suitable outlet for the dispensing or withdrawal of successive discrete blanks, and wherein the top is designed to receive stacks of fresh blanks, whenever necessary, in order to ensure that the supply of piled-up blanks in the magazine is not exhausted prior to termination of a shift or prior to switching to the making of different products, e.g., packets of cigarettes confined in differently colored and/or configurated and/or imprinted containers.

It is known to combine or assemble a magazine for stacks of cigarette packet blanks with, or to incorporate such magazine into, an apparatus wherein the magazine receives stacks of fresh blanks by way of a suitable conveyor. The latter can be provided with holders or grippers in the form of jaws or claws which are movable forwardly and backwards, as well as upwardly and downwardly, in order to transport successive stacks of superimposed cardboard, plastic, paper or other blanks from a source of stacks to a location close to or in a cigarette packing machine. If the packing machine is designed for the making of hinged-lid packets (e.g., for arrays of twenty cigarettes each in a customary so-called quincunx formation), the blanks are relatively stiff and are provided with pre-fabricated slits, slots, flaps, tucks, fold lines and/or other formations which ensure the making of short, medium long or long series of identical hinged-lid packets.

Since the blanks which are about to be introduced into a packing machine are normally withdrawn from the bottom of a stack in a magazine, the stack in the magazine should not be too high (and hence too heavy) in order to avoid damage to successive lowermost blanks during withdrawal from the bottom end of the magazine. Therefore, the supply of stacked blanks in the magazine should be replenished at rather frequent intervals; this reliably ensures that successive lowermost blanks in a magazine need not carry and need not slide relative to a rather heavy accumulation of registering blanks above it.

The situation is analogous (or even aggravated) in production lines which are designed for simultaneous turning out of several rows of packets containing arrays of plain or filter cigarettes or other rod-shaped smokers' products. In such production lines, the means for making and delivering blanks for hinged-lid packets and/or other types of containers for arrayed plain or filter cigarettes or the like must meet the requirements of two or more packing machines. Thus, it is necessary to set up two or more magazines (one for each packing machine) and an equal number of magazines for reception, temporary storage and continuous dispensing of rows or files of discrete blanks to each of a battery of two or more discrete packing machines. The situation is further aggravated if the magazines for the temporary storage of two or even more discrete stacks of paper, plastic, cardboard, foil or other suitable blanks are to receive stacks of superimposed blanks from a common source. This often gives rise to serious problems and is apt to necessitate temporary stoppage of one or more packing machines with attendant huge losses in output.

OBJECTS OF THE INVENTION

An object of the present invention is to provide a novel and improved apparatus for delivering supplies of stacked blanks or other types of normally flat superimposed commodities (from a single source or from two or more discrete sources) to one or more discrete blank processing machines in a highly predictable, safe and time-saving manner.

Another object of the invention is to provide a machine which turns out a surprisingly small number of rejects and which can be readily and rapidly converted for the manipulation and temporary storage of smaller, larger, lighter, heavier, rather simple or oddly configurated, stiff or readily deformable (such as elastic), sensitive and/or rugged commodities on their way from one or more sources to one or more consuming or processing machines, e.g., to one or more cigarette packing machines.

A further object of the invention is to provide a novel and improved method of manipulating stacks of superimposed sheets, panels, boards and/or other flat or substantially flat commodities on their way from one or more sources to one or more magazines which are associated with or incorporated into blank processing or consuming machines.

An additional object of the invention is to provide a novel and improved method of as well as a novel and improved apparatus for, manipulating blanks for the making of cigarete packets on their way from a blank making machine to a packing machine for cigarettes or the like.

Still another object of the invention is to provide a novel and improved method of storing superimposed commodities, particularly blanks for the making of cigarette packets, in magazines in such a way that the blanks can be readily and reliably withdrawn from their magazines and processed, and which can be practiced by resorting to relatively simple, long-lasting and compact apparatus.

A further object of the invention is to provide a novel and improved system of means for monitoring the commodities on their way toward as well as on their way into and in the magazine or magazines at one or more blank processing stations, e.g., in one or more packing machines for plain or filter cigarettes, cigarillos or other rod-shaped articles of the tobacco processing industry.

An additional object of the invention is to provide an apparatus of the above outlined character which is constructed and assembled in such a way that it can be combined with or incorporated into existing high-speed machines for the processing of prefabricated blanks or analogous commodities in tobacco processing plants, particularly in machines for the packing of plain or filter cigarettes or the like.

SUMMARY OF THE INVENTION

One feature of the present invention resides in the provision of an apparatus for replenishing the supply of superimposed commodities (e.g., prefabricated blanks of paper, cardboard, plastic material, metallic foil or the like) and for dispensal of commodities to at least one processing or consuming station (e.g., to a cigarete packing machine) with attendant reduction of the height of the supply of superimposed commodities. The supply of superimposed commodities can be established and maintained in at least one facility (e.g., a magazine for an upright stack of blanks), and such facility can serve to dispense successive lowermost commodities to one or more consumers. The improved apparatus comprises at least one signal-responsive conveyor (e.g., an overhead conveyor) which is movable between a source of stacks of superimposed commodities (such source can receive a series of stacks from a blank making and/or assembling unit) and a position (such as a predetermined position) above the at least one facility, means for monitoring the level of the uppermost commodity in the at least one facility including means for generating signals when the monitored commodity descends to a predetermined level (this normally denotes that the height of the supply of commodities in the at least one facility has been reduced to a predetermined level or is within a range of still acceptable levels), and means for effecting a gravitational descent of a stack of commodities from the conveyor onto the monitored commodity (i.e., from the predetermined position above the at least one facility onto the topmost commodity of the depleted supply of such commodities in the at least one facility). Such gravitational descent is or can be effected in direct or indirect response to the aforementioned signals in such a way that the extent of gravitational descent of successive (fresh or freshly assembled) stacks from the predetermined position above the at least one facility at least approximates a predetermined distance. This distance is or can be selected in such a way that the gravitational descent of a fresh stack into the at least one facility does not adversely affect the condition of the remaining supply of commodities in the at least one facility and/or the condition of commodities in the freshly delivered (and dropped) stack.

One of the presently preferred uses of the improved apparatus and its facility or facilities is to establish and maintain an optimum or a satisfactory supply of flat or substantially flat blanks which are to be converted into box-shaped containers of cigarette packets, such as those known as hinged-lid packets. Machines which can process blanks of the type adapted to be temporarily stored in and dispensed from apparatus of the present invention are distributed by the assignee of the present application.

The at least one conveyor of the improved apparatus can be equipped with holders in the form of grippers, arms, claws or the like which are movable in response to signals from the sensor or sensors of the monitoring means from operative positions of engagement with a stack of commodities to inoperative positions in which the theretofore engaged and supported stack is free to descend by gravity (and/or is otherwise caused to descend) from the at least one conveyor onto the monitored commodity in the at least one facility.

The apparatus further comprises means (such as one or more electric motors, fluid-operated motors and/or others) for moving the at least one conveyor along at least one of a plurality of mutually inclined paths in response to signals from the sensor or sensors of the monitoring means. For example, the paths can include at least one substantially horizontal path and at least one substantially vertical path. In accordance with a presently preferred embodiment (and if the apparatus comprises two magazines which are set up next to each other), the conveyor can be mounted for movement along a vertical path, along a first horizontal path, and along a second horizontal path at right angles to the first horizontal path. Such mounting renders it possible to rapidly and accurately advance the conveyor to and from the source of fresh stacks, to and from the required level above the one or the other of the two magazines, and (if necessary) downwardly toward or upwardly away from the selected magazine.

The monitoring means can further comprise means for monitoring the distance of the uppermost commodity in the at least one (or in the selected) facility from a lowermost commodity of a stack of commodities being held by the conveyor at the aforementioned position above the at least one facility (or the selected facility).

The signal generating means can comprise at least one sensor at a level above the uppermost commodity in the at least one facility, means for yieldably biasing the at least one sensor toward the uppermost commodity in the at least one facility, and a proximity detector which cooperates with the sensor to generate signals when the sensor assumes a predetermined position relative to the uppermost commodity in the at least one facility. The conveyor of such apparatus can comprise an at least substantially upright guide, and the at least one sensor can be mounted for movement along such guide. Furthermore, the at least one sensor can comprise an upward extension which supports the aforementioned proximity detector; such signal generating means can further comprise a stop (or analogous means) for arresting the proximity detector at a predetermined level above the monitored commodity in the at least one facility.

The signal generating means can comprise at least one photoelectronic detector with a radiation source and a radiation-responsive cell or an analogous detector for the uppermost commodity in the at least one facility.

If the at least one conveyor is movable up and down, the signal generating means can comprise a proximity detector which is movable with the at least one conveyor (i.e., up and down) and is arranged to generate signals when the uppermost commodity of the supply in the at least one facility is within a predetermined range of levels. Such apparatus can further comprise means for moving the at least one conveyor up and down at the position above the at least one facility and for moving the at least one conveyor downwardly at a speed below a predetermined maximum speed in response to signals from the proximity detector.

As already mentioned above, the improved apparatus can be designed to replenish supplies of superimposed commodities in a plurality of discrete facilities, e.g., in two facilities which are installed side-by-side. Such apparatus can further comprise means for moving the at least one conveyor to positions above any selected facility, depending upon which facility is to receive a fresh stack of commodities.

The commodities in the at least one facility or in each of several facilities are or can be at least substantially horizontal.

The apparatus can further comprise a frame (such as a gantry frame) and means (such as one or more carriages movable along suitable guide rails) for movably supporting the at least one conveyor on the frame.

Another feature of the present invention resides in the provision of a method of replenishing an upright supply of superimposed sheet-like commodities from which commodities are being withdrawn so that the height of the supply decreases. The method comprises the steps of monitoring the height of the supply and generating signals denoting the monitored height of the supply, delivering a stack of commodities to a predetermined level above the supply of commodities, and inducing a gravitational descent of the stack onto the supply of superimposed commodities in response to that one of the aforementioned signals which is indicative of a predetermined height of the supply.

The inducing step can include dumping the stack onto the supply of superimposed commodities when the supply descends to a level at a predetermined distance from the stacks at the predetermined level.

The predetermined level can be a fixed level or a level which is selected or determined by moving the stack downwardly toward the uppermost commodity of the supply.

It is presently preferred to withdraw the commodities from the bottom of the upright supply of superimposed commodities which can be confined in a magazine or another suitable receptacle.

The delivering step can include alternatively or otherwise conveying stacks of commodities to two or more neighboring or otherwise distributed expiring supplies of commodities.

The novel features which are considered as characteristic of the invention are set forth in particular in the appended claims. The improved apparatus itself, however, both as to the modes of assembling and operating the same, together with additional important features and attributes thereof, will be best understood upon perusal of the following detailed description of certain presently preferred specific embodiments with reference to the accompanying drawings.

DESCRIPTION OF PREFERRED EMBODIMENTS

Figure 1:
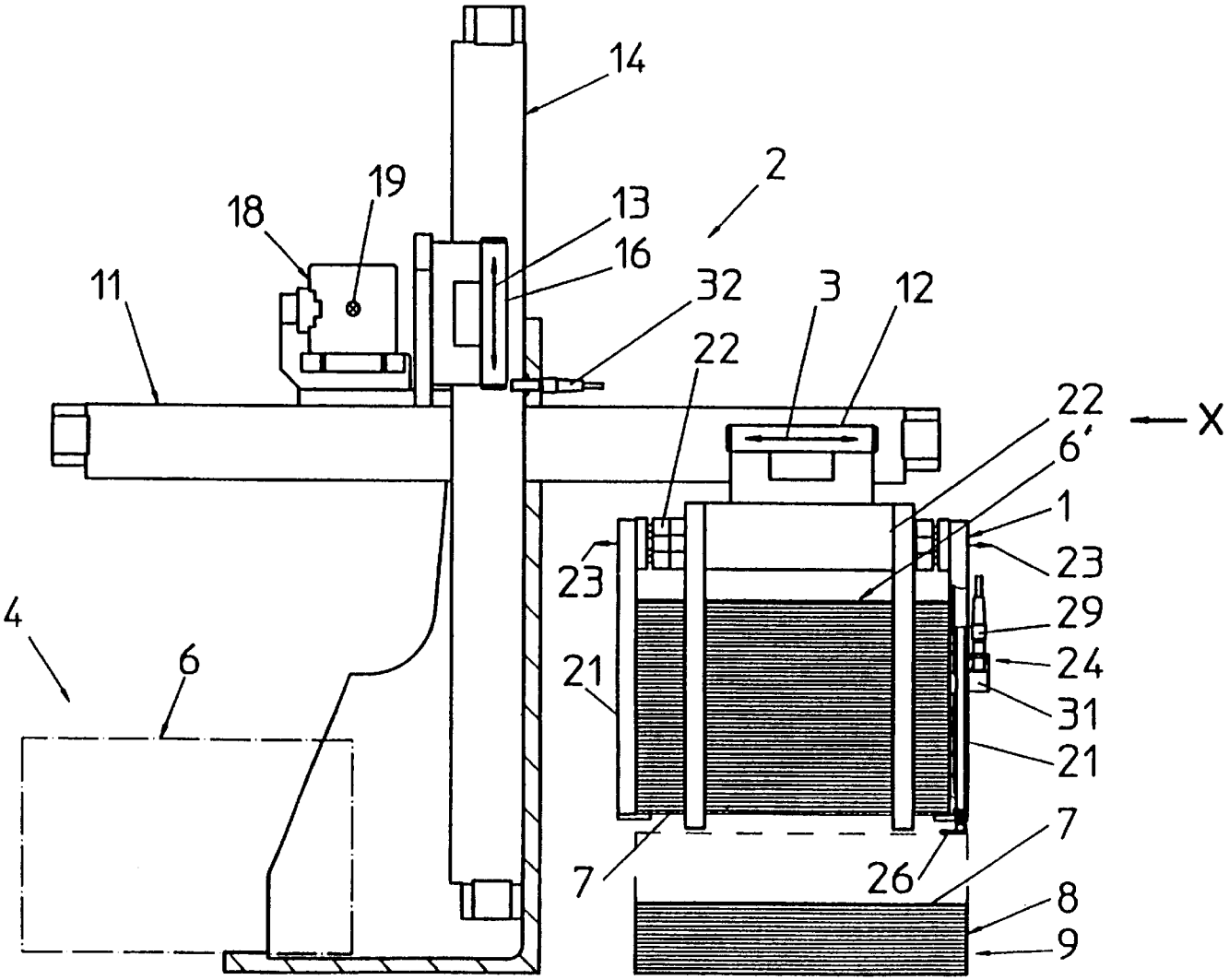
FIG. 1 is a side elevational view of an apparatus which embodies one form of the invention, the conveyor being shown in a position in which a fresh stack is held at a level above a supply of expiring commodities in one of two facilities in the form of magazines which serve for temporary storage of commodities and for dispensal of discrete commodities to one or more processing or consuming stations.
Figure 2:
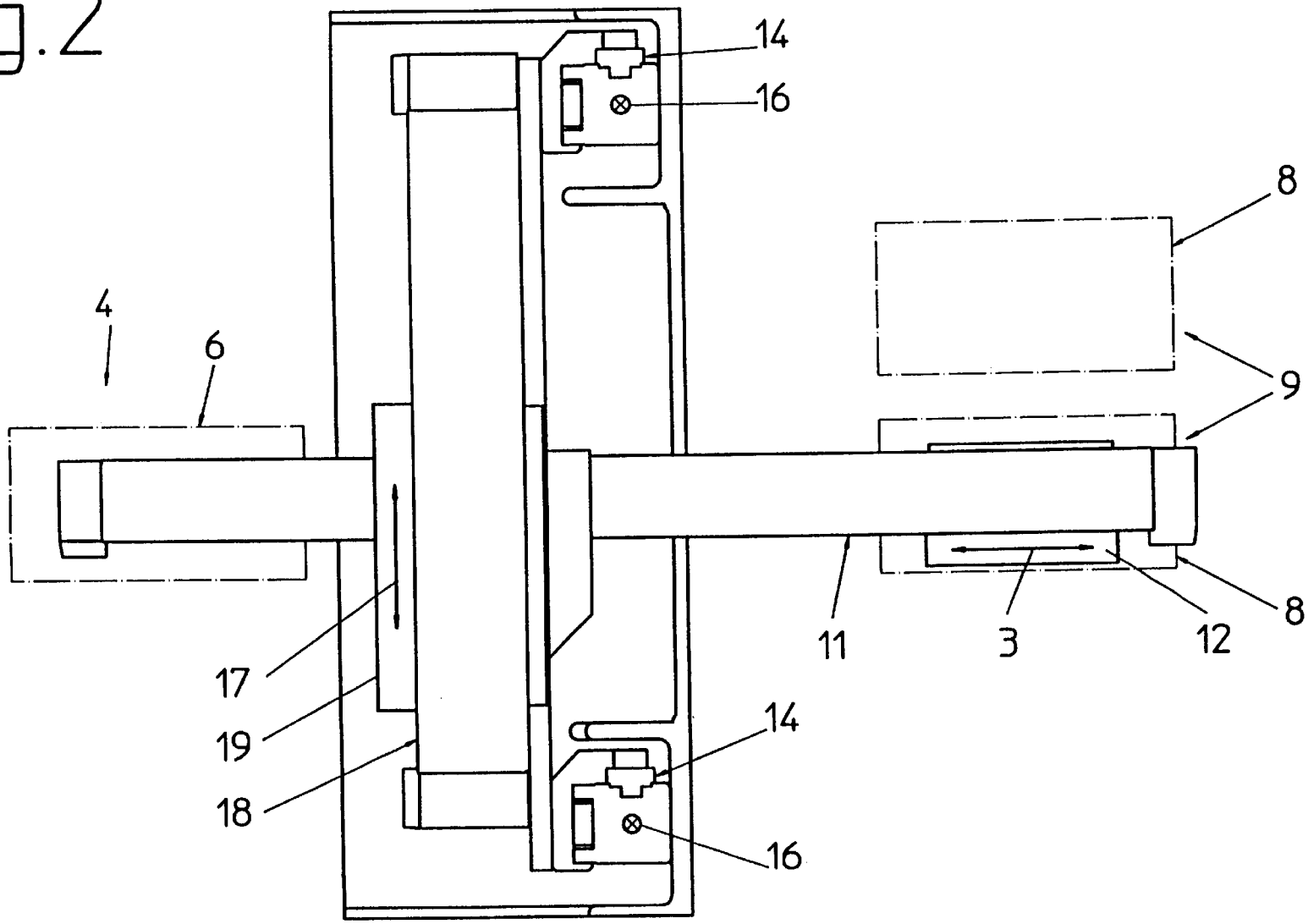
FIG. 2 is a plan view of the apparatus which is shown in FIG. 1.
Figure 3:
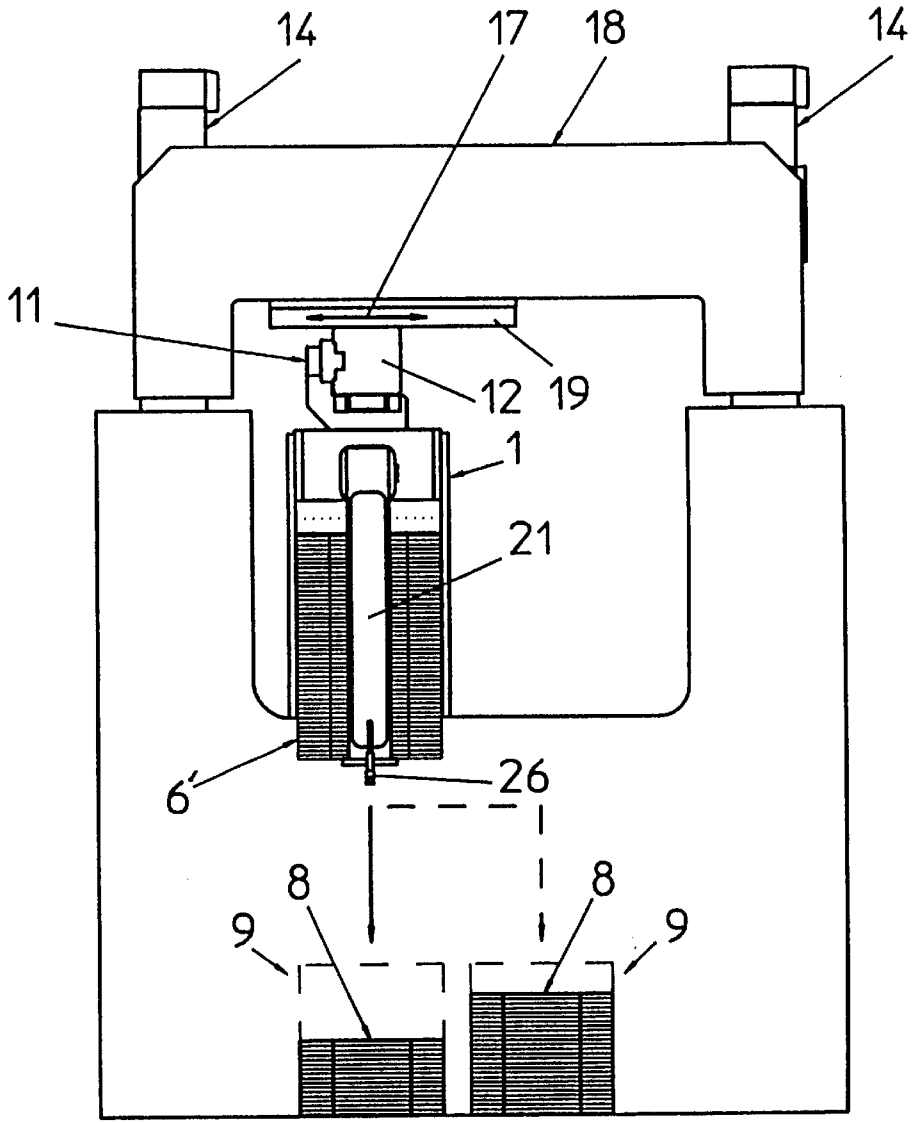
FIG. 3 is a front elevational view of the apparatus which is shown in FIGS. 1 and 2.

The apparatus which is shown in FIGS. 1 to 3 comprises a conveyor 1 mounted in a gantry frame 2 for movement along two horizontal paths (extending at right angles to each other and denoted by double-headed arrows 3 and 17) and along a vertical path (note the arrow 13). The reference character 4 denotes a station (disposed at one side of the frame 2) which constitutes, or receives a series of successive fresh stacks 6 from, a source of such stacks. Each stack 6 contains, or can contain, a predetermined number of superimposed flat or substantially flat horizontal commodities 7, e.g., sheet- or panel-shaped blanks which are to be converted into the containers or boxes of so-called hinged-lid packets normally containing arrays of twenty plain or filter cigarettes in the so-called quincunx formation.

An elongated horizontal beam 11 on the frame 2 defines a path or track for movements (arrow 3) of the conveyor 1 between the station 4 and one of two positions above the selected one of two facilities 9 for temporary storage or supplies 8 of superimposed commodities 7 (hereinafter called blanks for short). Each of the two facilities 9 which are shown in FIGS. 2 and 3 (FIG. 3 is a view as seen in the direction of arrow X in FIG. 1), and are located side-by-side, can constitute a standard magazine or receptacle which is designed to receive fresh stacks 6 from above (i.e., on top of the uppermost blank 7 in the respective supply 8). Furthermore, each magazine 9 is preferably designed to discharge successive lowermost blanks 7 of the respective supply 8, e.g., for advancement into a cigarette packing machine, not shown (e.g., into a packing machine known as COMPAS and distributed by the assignee of the present application). Both magazines 9 can supply series of discrete blanks to a common consuming or processing machine, or each of these magazines can furnish blanks to a discrete packing machine or the like.

The conveyor 1 is mounted on a first carriage 12 which is movable along the horizontal track 11 in the directions indicated by the arrow 3. The track 11 is movable along the underside of the horizontal overhead beam 18 of the gantry frame 2 by means of a second carriage 19 in directions indicated by the double-headed arrow 17. The beam 18 is movable vertically along two upright guides 14 of the frame 2 by means of an elevator 16 (see the double-headed arrow 13 in FIG. 1). Such practically universal movability of the conveyor 1 relative to and together with selected portions of the frame 2 renders it possible to pick up fresh stacks 6 at the station 4, to deliver a freshly picked up stack 6 from the station 4 to a predetermined position (see FIG. 1) at a level above the one or the other magazine 9, and to lower or raise the conveyor 1 at the station 4 or at a level above the one or the other magazine 9 (or, if necessary, at one or more locations between the station 4 and the magazines 9). The aforementioned tracks, guides, elevator and carriages constitute but one of several suitable systems for moving the conveyor 1 (or another suitable conveyor) up and down, forwardly and backwards as well as sideways. For example, one can assemble the means for moving the conveyor 1 (or another suitable conveyor) of parts or aggregates known as model DGPL-PPV-A-KF distributed by the Firm FESTO, Federal Republic Germany. Such parts or aggregates can employ or constitute pneumatic linear drives which can operate without pistons and can employ spherical circumferential guides.

The conveyor 1 comprises at least two holders 21 which can constitute downwardly extending walls, panels, arms or claws and are movable toward and away from each other to respectively engage or release the adjacent sides of a fresh stack 6' (e.g., to engage a fresh stack 6' at the station 4 and to dump such stack 6 onto the dwindling supply 8 of blanks 7 in the one or the other magazine 9). The means for moving the holders 21 toward or away from each other (i.e., in and counter to the directions indicated by the arrows 23 shown in FIG. 1) comprises electric motors 22 or other suitable prime movers which are operated by signals generated and processed by at least one monitoring device 24.

Figure 4:
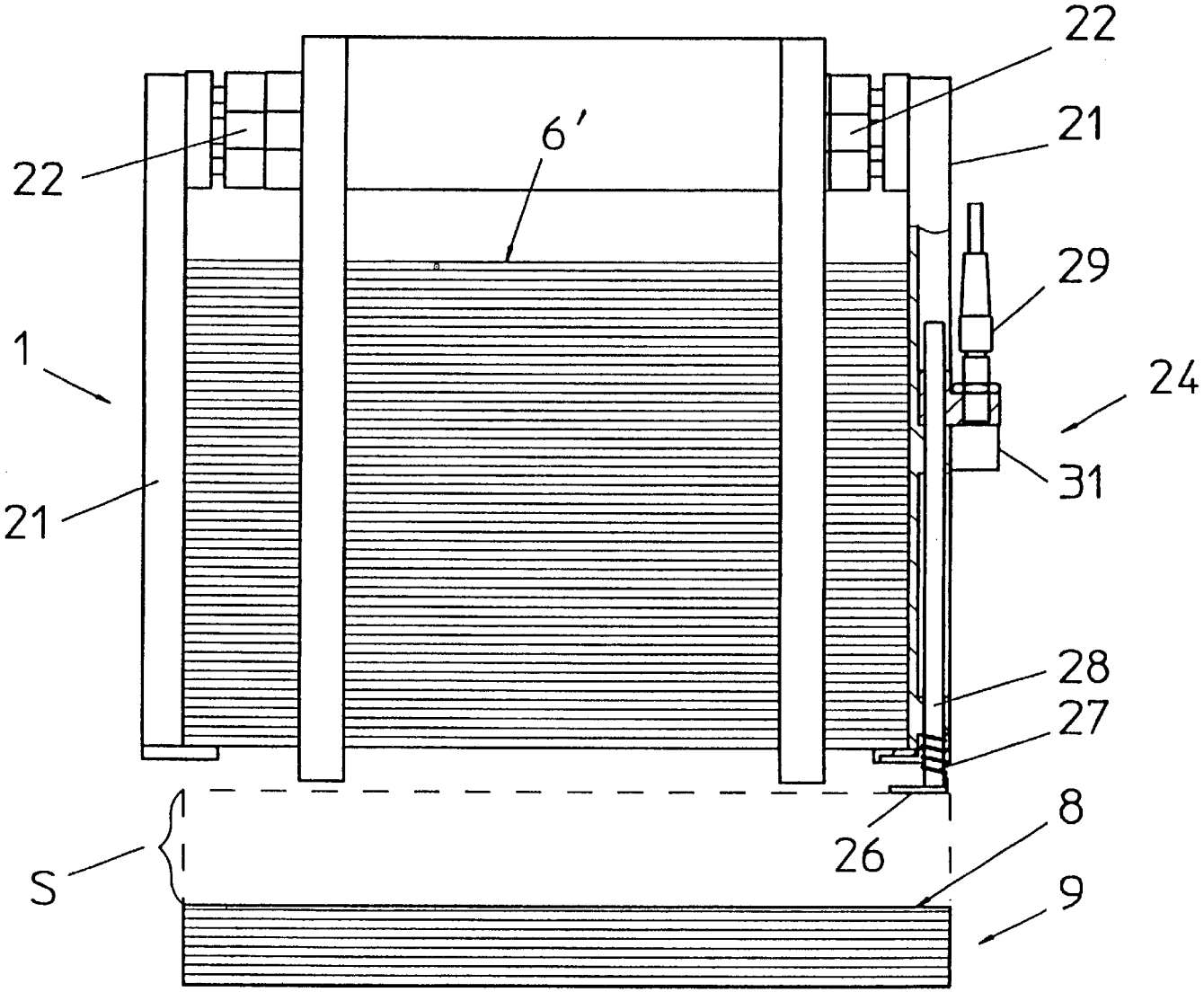
FIG. 4 is an enlarged view of that portion of the apparatus which is illustrated in the lower right-hand portion of FIG. 1, the conveyor and a fresh stack which is still held by the holding means of the conveyor being shown at a first (higher) level.

The illustrated monitoring device 24 comprises a sensor 26 having an upright follower or extension 28 and being biased downwardly by a relatively weak or slightly stressed coil spring 27 or an analogous energy storing device (see FIG. 4). The follower 28 is guided in one of the holders 21 forming part of the conveyor 1.

The extension 28 carries a suitable signal generating proximity detector 29 which is movable up and down relative to the conveyor 1 and cooperates with an abutment or stop 31 at the outer side of that holder 21 which guides the follower 28.

A second proximity detector 32 (which can form part of the monitoring device 24 or of a discrete second monitoring device) is set up to cooperate with the elevator 16.

The mode of operation of the apparatus which is shown in FIGS. 1 to 3 is as follows:

When at least one of the supplies 8 in the respective magazine 9 is depleted to a certain preselected level (e.g., to the level of the topmost blank 7 of the supply 8 in the left-hand magazine 9 of FIG. 3), the means for moving the conveyor 1 receives a command to replenish the supply 8 in the respective magazine. Such signal can be generated by a sensor of the monitoring device 24. If not already there, the conveyor 1 is moved to the station 4 and descends while its holders 21 are being held in spaced-apart positions by the prime movers 22 so that the fresh stack 6 at the station 4 can be grasped and lifted as soon as the conveyor 1 and the track 11 complete their downward movement (i.e., a movement in one of the directions indicated by the double-headed arrow 13).

The next step involves a lifting of the track 11 (with the loaded conveyor 1) by the elevator 16 and a preferably rapid movement of the conveyor toward the position shown in FIGS. 1 to 3, namely at the level above the left-hand magazine 9 of FIG. 2. If the blank processing machine (such as a cigarette packing machine) which normally receives successive lowermost blanks 7 from the bottom of the supply 8 in the left-hand magazine 9 of FIG. 3 continues to process successive blanks, the supply 8 in such magazine continues to be depletdd. Thus, the level of the uppermost blank 7 in such supply descends within the range S (see FIG. 4).

The conveyor 1 begins to descend (e.g., automatically) as soon as it reaches the position of FIG. 3, and such descent takes place at a speed exceeding the speed of downward movement of the topmost blank 7 of the supply 8 in the left-hand magazine 9 of FIG. 3. At any rate, the sensor 26 is in the process of catching up with the adjacent topmost blank 7 while the latter is still within or at the lowermost point of the aforementioned range S of levels. This causes the fresh stack 6' and the conveyor 1 to descend relative to the arrested sensor 26, i.e., against the opposition of the spring 27. The proximity detector 32 responds by reducing the speed of the elevator 16, i.e., the downward movement of the conveyor 1 and of the fresh stack 6' therein is slowed down. Alternatively, the arrangement can be (and preferably or normally is) such that the proximity detector 32 slows down the descending conveyor 1 before the sensor 26 reaches the topmost blank 7 of the partially depleted supply 8 in the respective magazine; this ensures that the elevator 16 lowers the conveyor 1 at a relatively low (searching or seeking) speed before the sensor 26 comes into actual contact with the topmost blank 7 below it.

Figure 5:
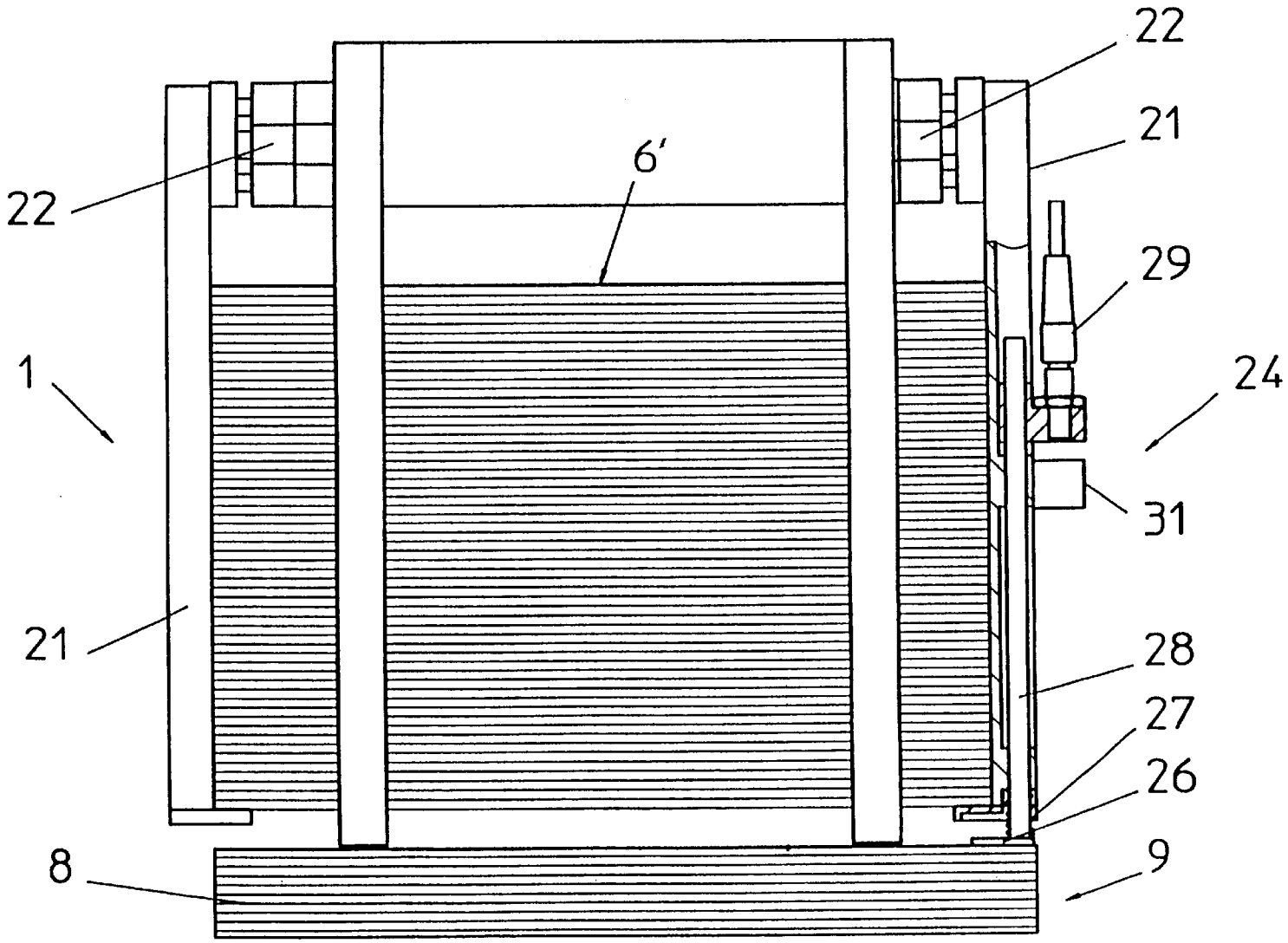
FIG. 5 shows the structure of FIG. 4 but with the conveyor and the stack (which is still held by the conveyor) shown at a lower level nearer to the topmost commodity in the supply of commodities confined in the magazine being then overlapped by the conveyor.
Figure 6:
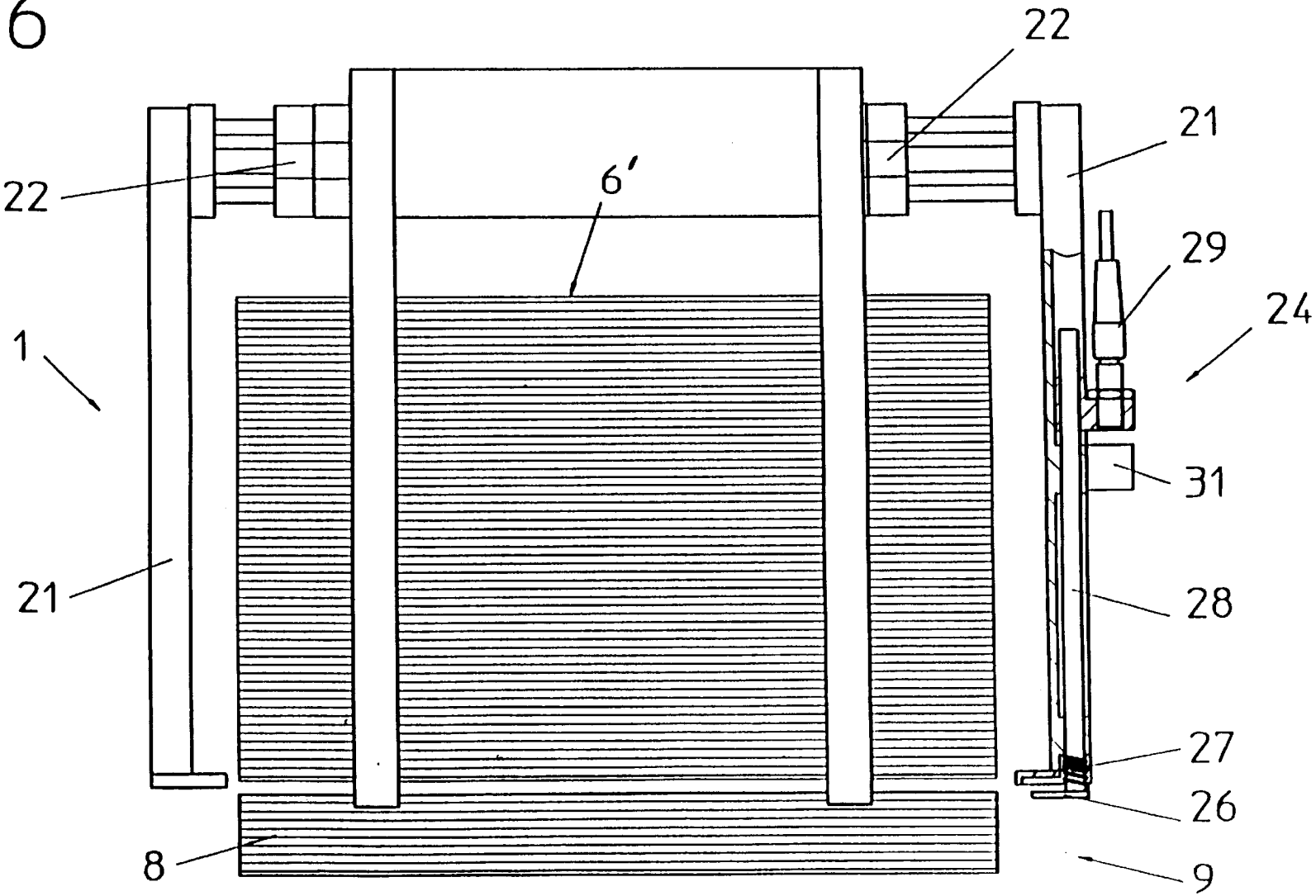
FIG. 6 shows the structure of FIG. 5 but with the fresh stack during gravitational descent onto the topmost commodity of the supply of commodities beneath the conveyor.

That stage of downward movement of the conveyor 1 when the sensor 26 actually contacts the adjacent topmost blank 7 of an expiring supply 8 is shown in FIG. 5. At such time, the proximity detector 29 activates the prime mover(s) 22 so that the holders 21 of the conveyor 1 are moved apart (in the directions indicated by the arrows 23) and the conveyor 1 dumps the fresh stack 6' onto the remainder of the supply 8 in the respective magazine 9. FIG. 6 shows the conveyor 1 in the open condition and the fresh stack 6' during gravitational descent (e.g., during a last stage of such descent) onto the partially exhausted supply 8 of blanks 7 in the magazine 9 below the conveyor. The dropping or dumping distance is selected in such a way that the mutual positions of the blanks 7 in the replenished supply 8 are acceptable, i.e., the magazine 9 is ready to continue to supply successive lowermost blanks to the associated consumer or consumers.

It will be seen that a feature of the invention resides in such construction and mode of operation of the improved apparatus that a freshly picked up and delivered full-sized (or even smaller) stack 6' is permitted to descend by gravity from the conveyor 1 onto an expiring supply 8 only when the bottom blank of the stack is sufficiently close to the top blank of the supply 8 below it that such dumping does not adversely affect the distribution of blanks in the thus replenished supply 8.

Another important advantage of the improved apparatus is that the dumping of a stack 6' need not take place from an exactly determined level. Instead, the monitoring unit 24 (either alone or in conjunction with one or more additional monitoring units) can ensure that the dumping can take place within a selected range of levels, namely while the topmost blank of the supply in the one or the other magazine 9 is in the process of descending within the range S or another selected range.

Once the dumping of a fresh stack 6' is completed, the empty conveyor 1 can automatically return to a position of readiness at the station 4 which is in the process of receiving (or has already received) a fresh stack 6 in a manner not forming part of the present invention (e.g., from a belt or chain or roller conveyor (not shown) or directly from a cutter which serves to subdivide a continuous web or strip into discrete blanks).

The manner in which the supply 8 in the right-hand magazine 9 of FIG. 3 is replenished (when necessary) is the same as described above except that the sensor (not specifically shown) which monitors the level of the topmost blank 7 in this magazine transmits a signal which is processed to ensure that the conveyor 1 (with a fresh stack 6 between its holders 21) is advanced to a level above such magazine.

It is clear that, if the operation of the machine or machines receiving blanks from the magazines 9 is automatic (i.e., predictable) for extended periods of time, the monitoring unit 24 can be deactivated or set to automatically ensure certain sequences of movement and operation of the conveyor 1 at predetermined intervals.

The proximity detector 29 can be put to use to ensure that a fresh stack 6' is invariably dumped from the same level, i.e., at an exactly determined distance from the topmost blank 7 of the supply 8 in the magazine 9 below it. This is ensured in that the dumping takes place when the sensor 26 reaches the level of the adjacent topmost blank 7 and is lowered by the elevator 16 so that the spring 27 stores energy and the extension 28 moves the proximity detector 29 relative to the stop 31 (or vice versa) until a signal from the detector 29 initiates a movement of the holders 21 away from each other (in the directions indicated by the arrows 23) with attendant dumping of the fresh stack 6'. As a rule, the stop 31 is affixed to the respective holder 21 of the conveyor 1. The just described mode of operation ensures that the circumstances during actual dumping of a stack 6' are always the same regardless of the actual level of the topmost blank 7 in the partially depleted supply 8 in the magazine 9 below the conveyor.

The proximity detector 32, which constitutes a means for varying the speed of the elevator 16, constitutes a highly desirable and advantageous but optional feature of the monitoring device 24 or a discrete second monitoring device. An advantage of such proximity detector is that the conveyor 1 can move up and/or down at an elevated speed except within that range when the fresh stack 6' between the holders 21 is about to be dumped upon an expiring supply 8. This ensures that the improved apparatus can select the actual dumping distance (i.e., the distance being covered by the lowermost blank 7 of a fresh stack 6 during unrestricted downward movement toward the topmost blank 7 of the expiring supply 8 below the conveyor 1) can be selected with a very high degree of accuracy.

The exact construction of the proximity detector 29 and/or 32 forms no part of the present invention. For example, at least one of these detectors can be a mechanical or reflection type proximity detector.

Each embodiment of the improved method and apparatus exhibits the important advantage that the topmost blank of an expiring supply and/or the lowermost blank of a fresh stack is highly unlikely to be deformed, scored, otherwise defaced and/or otherwise damaged during transport of stacks 6 from the station 4 to a position above a single magazine or to a position above one of two or more magazines, as well as during or as a result of dumping of the fresh stack onto an expiring supply 8. Moreover, and since the conveyor 1 can be advanced at a reasonably high speed, at least during movement between the station 4 and the level above a single magazine 9 or above one of several magazines, the fresh stack 6 need not be extremely tall and hence heavy; this even further reduces the likelihood of damage to the lowermost blank of a fresh, stack and/or to the uppermost blank of an expiring supply of blanks.

Figure 7:
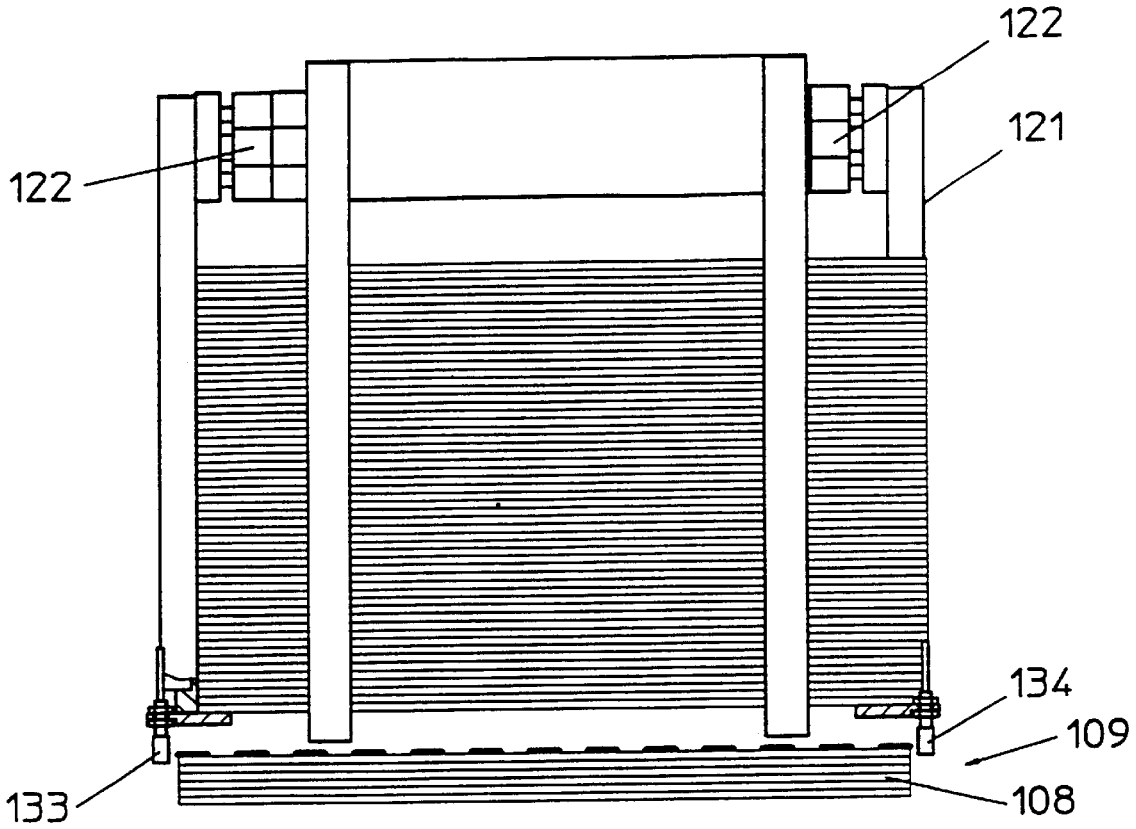
FIG. 7 is a side elevational view similar to that of FIG. 5 but showing certain parts of a modified monitoring unit.
Figure 8:
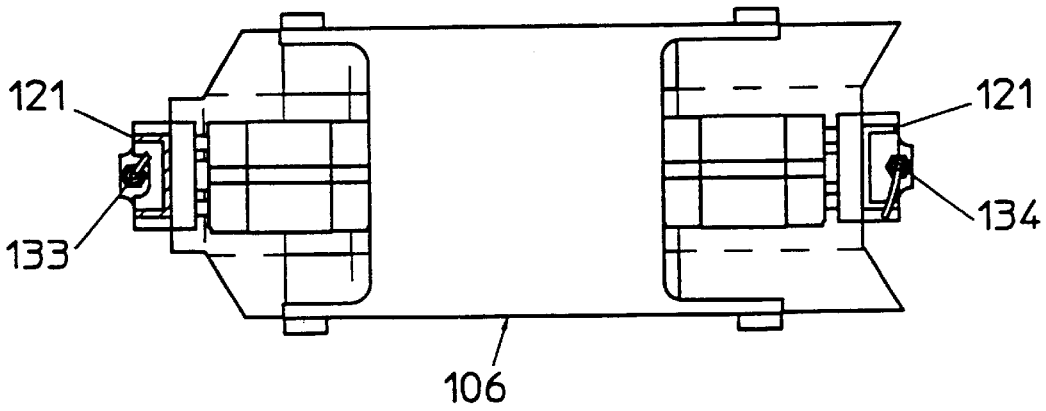
FIG. 8 is a plan view of the structure which is shown in FIG. 7.

The apparatus which employs the conveyor of FIGS. 7 and 8 is equipped with a modified monitoring device. All parts of the structure shown in FIGS. 7 and 8 which are identical with or clearly analogous to the corresponding parts of the apparatus shown in FIGS. 1 to 6 are denoted by similar reference characters plus 100.

In this modified apparatus, the sensor 26 of the monitoring device 24 is replaced with a photosensitive signal generating device including a radiation source 133 and a photoelectronic detector 134. These parts cooperate to ascertain the level of the topmost blank in the supply 108 which is confined in the illustrated single magazine 109 or in one of two or more magazines arranged to receive stacks 106 by way of the conveyor including the holders 121. Signals from the photosensitive signal generating device 133, 134 can be utilized to operate the prime movers 122 which serve to move the holders 121 between (a) spaced-apart positions so that the conveyor dumps a fresh stack 106 from an acceptable or optimum level above the topmost blank of the diminishing or dwindling supply 108, and (b) the illustrated positions.

It is clear that, though the preceding description repeatedly refers to commodities (such as 7) in the form of blanks, particularly for use in the tobacco processing industry, the improved method and apparatus can be put to an equally satisfactory use in numerous other fields wherein supplies of superimposed commodities must be replenished with stacks of additional commodities in such a way that the distribution of the commodities in the replenished supplies will remain at least substantially unchanged.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of methods of and apparatus for replenishing the supply of commodities in a reservoir and, therefore, such adaptations should and are intended to be comprehended within the meaning and range of equivalence of the appended claims.

What is claimed is:

1. Apparatus for replenishing from a source of stacks of superimposed commodities a supply of superimposed commodities disposed in at least one facility for temporary storage of said supply of superimposed commodities and for dispensal of the commodities from the temporary storage to at least one consuming station with attendant reduction of the height of the supply of superimposed commodities, comprising:

at least one signal-responsive conveyor movable between the source of stacks of superimposed commodities where a stack of superimposed commodities is to be loaded on said conveyor and a position above said at least one facility;

means for monitoring the level of the uppermost commodity of the supply in said at least one facility, including means for generating signals when the monitored commodity descends to a predetermined level; and means for effecting a gravitational descent of a stack of commodities from said conveyor onto the monitored commodity in said at least one facility in response to said signals so that the extent of gravitational descent of successive stacks of commodities from said conveyor onto said monitored commodity at least approximates a predetermined distance.

2. The apparatus of claim 1, wherein said at least one facility is constructed for temporary storage of stacks of superimposed blanks of wrapping material.

3. The apparatus of claim 1, wherein said at least one conveyor has holders movable in response to said signals from operative positions of engagement with a stack of commodities to inoperative positions in which the theretofore engaged stack is free to descend by gravity from the at least one conveyor onto the monitored commodity in said at least one facility.

4. The apparatus of claim 1, further comprising means for moving said at least one conveyor along at least one of a plurality of paths in response to said signals.

5. The apparatus of claim 4, wherein said paths include at least one at least substantially horizontal path and at least one at least substantially vertical path.

6. The apparatus of claim 1, wherein said monitoring means further comprises means for monitoring the distance of the uppermost commodity in said at least one facility from a lowermost commodity of a stack of commodities being held by said conveyor at said position above said at least one facility.

7. The apparatus of claim 1, wherein said signal generating means comprises at least one sensor at a level above the uppermost commodity in said at least one facility, means for yieldably biasing said at least one sensor toward the uppermost commodity in said at least one facility, and a proximity detector cooperating with said sensor to generate signals when said sensor assumes a predetermined position relative to the uppermost commodity in said at least one facility.

8. The apparatus of claim 7, wherein said conveyor comprises an at least substantially upright guide and said at least one sensor is movable along said guide.

9. The apparatus of claim 7, wherein said at least one sensor comprises an upward extension supporting said proximity detector and said signal generating means further comprises means for arresting said proximity detector at a predetermined level above the monitored commodity in said at least one facility.

10. The apparatus of claim 1, wherein said signal generating means comprises at least one photoelectronic detector for the uppermost commodity in said at least one facility.

11. The apparatus of claim 1, wherein said at least one conveyor is movable up and down and said signal generating means includes a proximity detector movable with said at least one conveyor up and down and being arranged to generate signals when the uppermost commodity of the supply in said at least one facility is within a predetermined range of levels.

12. The apparatus of claim 11, further comprising means for moving said at least one conveyor up and down at said position above said at least one facility and for moving said at least one conveyor downwardly at a speed below a predetermined maximum speed in response to signals from said proximity detector.

13. The apparatus of claim 1 for replenishing supplies of superimposed commodities in a plurality of discrete facilities, further comprising means for moving said at least one conveyor to positions above selected ones of said plurality of facilities.

14. The apparatus of claim 1, wherein said at least one facility comprises a magazine for a stack of at least substantially horizontal commodities.

15. The apparatus of claim 14, wherein the commodities comprise blanks for conversion into hingedlid packets for substantially rod-shaped smokers' products.

16. The apparatus of claim 1, further comprising a frame and means for movably supporting said at least one conveyor on said frame.

17. The apparatus of claim 16, wherein said frame includes a gantry frame.

* * * * *